United States Patent [19]

Kirchner

[11] Patent Number: 4,625,926

[45] Date of Patent: Dec. 2, 1986

[54] MULTIPLE DISK REFINER WITH ELASTOMERIC MOUNTING

[75] Inventor: Edward C. Kirchner, Pittsfield, Mass.

[73] Assignee: Beloit Corporation, Beloit, Wis.

[21] Appl. No.: 669,539

[22] Filed: Nov. 8, 1984

[51] Int. Cl.[4] ..... B02C 7/14

[52] U.S. Cl. ..... 241/261.2; 241/297; 241/DIG. 30

[58] Field of Search ..... 241/261.2, 261.3, 251, 241/DIG. 30, 102, 296, 297, 298, 163

[56] References Cited

U.S. PATENT DOCUMENTS

| | | | |
|---|---|---|---|
| 360,670 | 4/1887 | Etnier, Jr. | 241/DIG. 30 X |
| 1,995,549 | 3/1935 | Myers | 241/296 X |
| 2,567,448 | 9/1951 | Rickerich, Jr. et al. | 241/296 |

FOREIGN PATENT DOCUMENTS

| | | | |
|---|---|---|---|
| 527395 | 7/1956 | Canada | 241/163 |

*Primary Examiner*—Mark Rosenbaum

*Attorney, Agent, or Firm*—Hill, Van Santen, Steadman & Simpson

[57] ABSTRACT

An improved multiple disk refiner of the type employing a rotatable hub which is mounted for rotation within a housing, and a plurality of spaced refiner rotor disks and additional disks in interleaved relation with each other and defining passages through which a stock suspension to be refined can be passed. Relative rotational movement occurs between the rotor disks and the additional disks. The invention is particularly concerned with an improved rotor structure which is mounted on the hub for rotation therewith, and resilient coupling means which connect the rotor with the rotor disks. The coupling means include a resiliently deformable elastomer which is arranged to deform in a shearing mode thereby permitting increased axial deflection of the rotors and operation at a higher intensity level.

6 Claims, 5 Drawing Figures

MULTIPLE DISK REFINER WITH ELASTOMERIC MOUNTING

BACKGROUND OF THE INVENTION

1. Field of the Invention

This invention is in the field of multiple disk refiners employing sets of stationary spaced stator disks and refiner rotor disks between which are provided refining gaps for passing the stock suspension to be treated. The invention makes use of a plurality of flexible rotors which are mounted for rotation within the refiner housing and are coupled to the rotor disks by means of a resilient coupling means which includes a resiliently deformable elastomer arranged to deform in a shearing mode and thereby accommodate increased axial deflection of the rotors.

2. Description of the Prior Art

After paper stock has come from beaters, digesters or other pulping machines, it is usually refined by passing it between grinding or refining surfaces which break up the fibrous materials and serve to create further separation and physical modification of the fibers.

A typical pulp refiner is disclosed in Thomas U.S. Pat. No. 3,371,873. This type of refiner includes a rotating disk which has annular refining surfaces on one or both sides. The disk refining surfaces are in confronting relation with nonrotating annular grinding surfaces and provide therebetween a refining zone in which the pulp is worked. The rotating disk and the refining surfaces are made of rigid material such as cast iron or a hard stainless steel. The non-rotating grinding surfaces are made of similar materials and are rigidly mounted so as to resist the torque created by the rapidly rotating disk and the pressure on the pulp material passing through the refining zone gap. Axial adjustment of the refining zone gaps is effected by axial shifting of the shaft on which the disk is mounted.

Rigid disk refiners of this type must be manufactured and assembled to close tolerances in order to set the refining zone gap width correctly. Because the loads supplied to the rigid disk are large during the refining process, a large and extremely rugged design is necessary so that the refining surface relationships do not change under load. This results in the rigid disk refiners being very costly due to the necessarily close tolerance machining, the need for large quantities of high strength disk material, the bulky overall structure, the restrictive machine capacity, and the excessive assembly time requirements.

Substantial improvements in pulp refiners have recently been accomplished with the development of a multiple disk refiner which is usually designed to operate at a low intensity. In copending Matthew and Kirchner pending U.S. Ser. No. 486,006 entitled "Flexible Disk Refiner and Method", now U.S. Pat. No. 4,531,681 issued July 30, 1985, assigned to the same assignee as the present application, there is disclosed a refining apparatus which includes a plurality of radially extending, relatively rotatable and axially confronting refining surfaces between which the suspension passes while being refined during relative rotation of the surfaces. Means are provided for effecting flow of the material radially between and across the surfaces. The supporting means employed in that application consists of resiliently flexible supporting means which permit adjustment of the relatively rotating refining surfaces axially relative to each other depending on the operating pressures so that optimum material working results from the refining surfaces.

In the specific embodiment disclosed in the aforementioned application, there is provided a pulp refiner with ring-shaped refining surface plates of limited radial width which are mounted on interleaved margins of axially resilient flexible or deflectable disk elements. Disk margins spaced from the interleaved margins on one set of the disk elements are secured to a rotor while the margins on another set of disks are secured non-rotatably or counter-rotatably. The refining surface plates are made of a suitably hard, substantially rigid material. The disk elements, on the other hand, are made of axially resilient flexible material which strongly resists deformation in the radial and circumferential directions. Because of the manner in which the axially flexible disk elements are supported, there is an automatic axial self-adjustment of the refining surfaces during the pulp-refining process for attaining optimum refining action by the relatively rotating refining surfaces.

The multiple disk refiner represents a substantial improvement in the art of refining. It has been shown that with the use of a low intensity, multiple disk refiner, pulp characteristics can be improved considerably over those obtained by using conventional refining techniques. Originally, such refiners were built using flexible diaphragms to restrain the refining disks and to provide the torsional rigidity required to transmit rotational forces into the refining surfaces. The resiliency of the diaphragms permitted sufficient axial motion of the refiner disks such as required as each surface moves into close proximity to its adjacent neighbors as the refiner is loaded to its operational position.

Previous flexible disk designs permit a limited amount of flexibility because after initial deflection occurs from a bending mode, tensile forces restrain further axial deflection. In the case of low intensity refining applications, excessive plate wear does not occur and large axial deflections are not required. With higher intensities, however, disk wear becomes an important factor and in a multiple disk environment, such wear requires significant axial deflections which are not obtainable with present designs for multiple disk refiners.

SUMMARY OF THE INVENTION

The present invention provides an improved multiple disk refiner embodying a housing, a rotatable hub mounted for rotation within the housing, and a plurality of spaced refiner rotor disks concentric with the rotatable hub. An additional plurality of spaced disks are provided in interleaved confronting relation with the rotor disks, either stationary or counterrotating, so as to define passages therewith through which a suspension to be refined can be passed. A plurality of flexible rotors are mounted on the hub for rotation therewith. Resilient coupling means connect the rotors with the rotor disks, the coupling means including a resiliently deformable elastomer which is arranged to deform in a shearing mode thereby permitting increased axial deflection of the rotors. In a preferred form of the invention, the rotors have radially extending spokes and the rotor disks have slots therein into which the spokes extend in loosely fitting relation, the elastomer filling the spaces between the spokes and the slots whereby the ends of the spokes are bonded to the elastomer, and the elastomer is also bonded to the walls of the slots with that portion of the elastomer between the rotor and the walls of the slot being subjected to shearing deformation.

In addition, only a bending deformation of the spoke occurs during axial deflection, as the shear of the elastomer accounts for tensile deformation. The elastomer also tends to keep the rotor centered and assists in reducing imbalance. Further, the elastomer will act as an energy absorber for use in damping machine induced vibrations.

In the preferred form of the invention, spaced support means are provided from which flexible fingers extend, the additional disks having slots therein which receive the fingers in loosely fitting relation. A resiliently deformable elastomer is provided to fill the slots about the fingers so as to permit shearing deformation of the elastomer upon axial deflection of the fingers.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
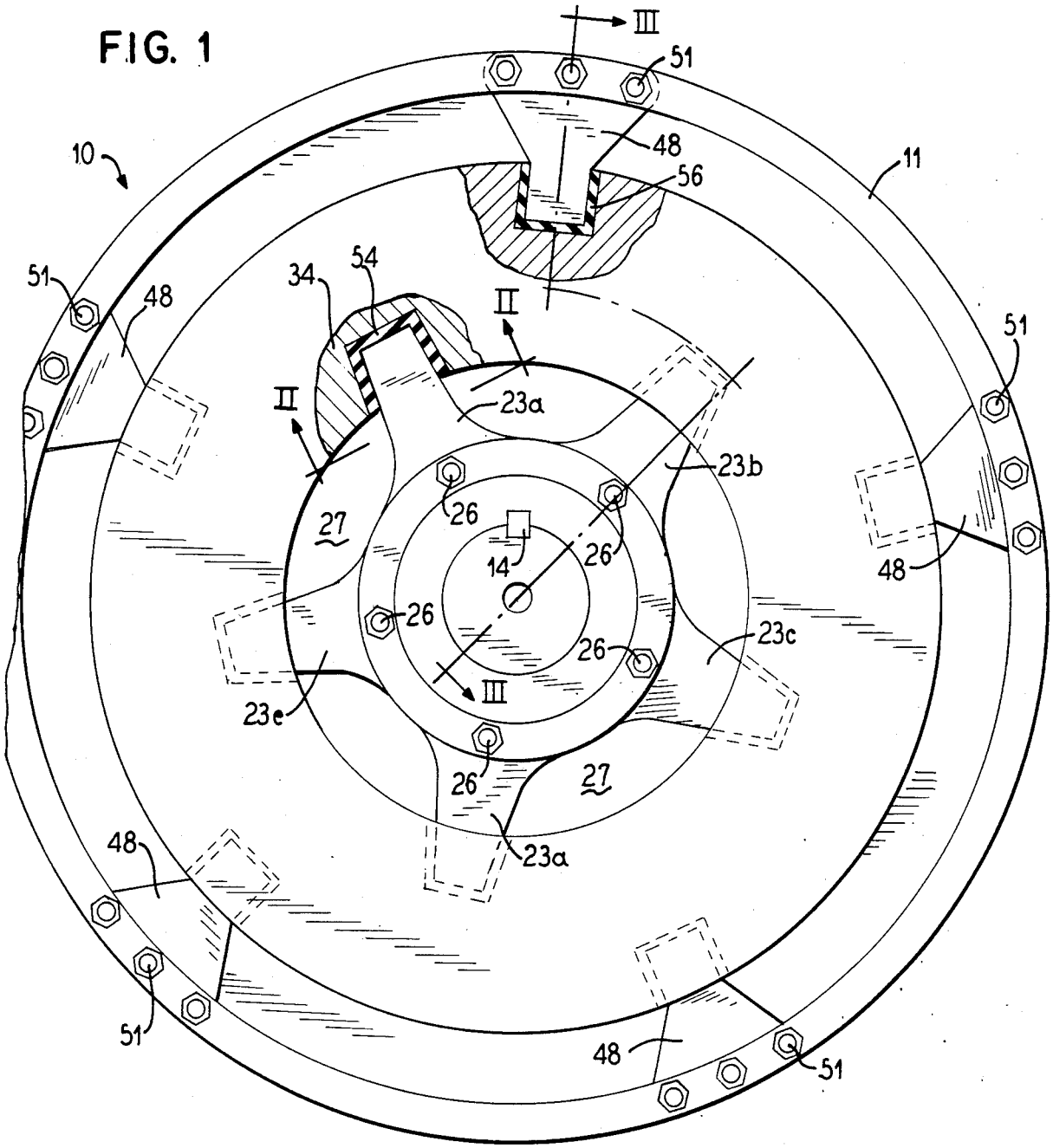
FIG. 1 is a view of an improved multiple disk refiner according to the present invention, partly in elevation and partly in cross section, with portions broken away to better illustrate the structure thereof.
Figure 2:
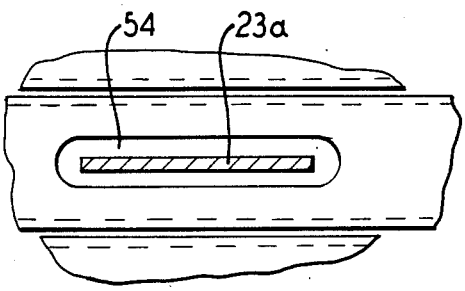
FIG. 2 is a cross-sectional view on an enlarged scale taken substantially along the line II—II of FIG. 1.
Figure 3:
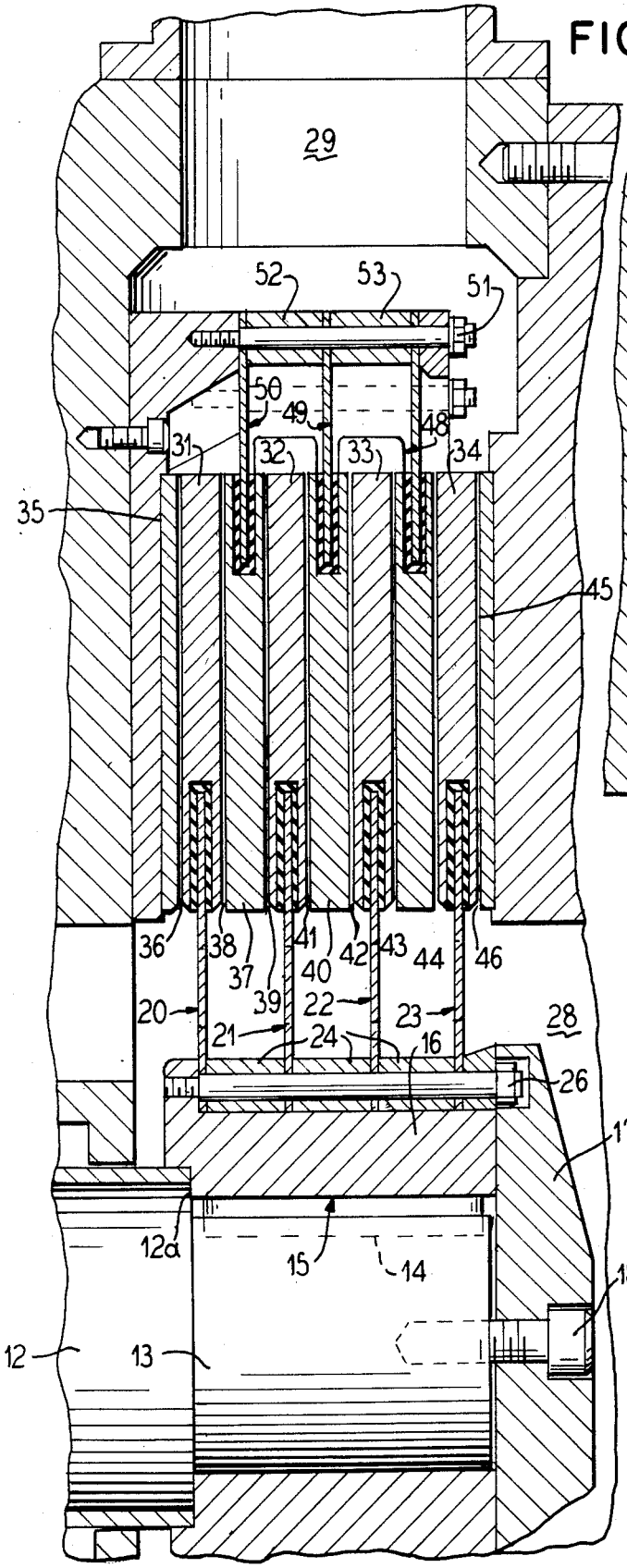
FIG. 3 is a cross-sectional view taken substantially along the line III—III of FIG. 1.

In FIG. 1 reference numeral 10 indicates generally a multiple disk refiner of the type with which the present invention is concerned. The refiner 10 includes a housing 11 into which extends a driven shaft 12 (FIG. 3). The shaft 12 has a step-down hub portion 13 which is keyed by means of a key 14 to a rotor assembly generally indicated at reference numeral 15. The rotor assembly 15 has a hub 16 which is confined against axial movement by means of the shoulder 12*a* and a thrust plate 17 secured to the stub shaft 13 by means of a bolt 18.

The rotor assembly 15 includes individual rotor elements 20, 21, 22 and 23 as best illustrated in FIG. 3. Spacers 24 are provided to provide the proper spacing at the inner ends of the rotor assembly, the various rotors being secured to the hub 16 by means of bolts 26.

As best seen in FIG. 1, each of the rotors 20 to 23 has five equally spaced radially extending spokes such as spokes 23*a* through 23*e*. The spokes are separated by arcuate recesses 27 which direct the flow of the stock suspension therethrough. The stock suspension enters the refiner through an inlet portion 28 and exits through a discharge portion 29 best shown in FIG. 3. In passing between the inlet 28 and the outlet 29, the stock suspension is subjected to a refining action between a plurality of interleaved spaced refiner rotor disks and alternating spaced stator disks. In the illustrated form of the invention, there are provided four rotor disks 31, 32, 33 and 34. The rotor disk 31 confronts a stationary end plate 35 to provide a refining gap 36 therebetween. Confronting faces of the rotor disk 31 and the end plate 35 are provided with angularly extending ribs which serve to abrade the suspended fibers and fibrillate the same into a uniform suspension. The opposite side of the rotor disk 31 also has refining surfaces thereon which confront corresponding refining surfaces on a stator disk 37, the rotor and stator disks being separated by a refining gap 38. The second rotor disk 32 is separated from the opposite side of the stator disk 37 by means of a refining gap 39. In like manner, there is provided a second stator disk 40 which confronts the opposite surface of the rotor disk 32 across a gap 41. A gap 42 separates the opposite working surface of the stator disk 40 from the third rotor disk 33. A third stator disk 43 is spaced from the rotor disk 34 by means of a gap 44. A stationary end plate 45 confronts the opposite side of the rotor disk 34 along a refining gap 46.

The stators are supported within the refining chamber by means of flexible sets of fingers. These fingers have been identified at reference numeral 48 in conjunction with stator disk 43, reference numeral 49 in conjunction with stator 40, and reference numeral 50 in conjunction with stator disk 37. The fingers are secured to the housing 11 by means of bolts 51. Spacers 52 and 53 located between the sets of fingers provide the proper axial spacing at the anchored ends of the fingers.

The spoked rotors 20 to 23 and the fingers 48 to 50, inclusive, may be made of a flexible material such as a fiberglass composite wherein glass fibers are embedded in a matrix of a polyester or epoxy resin, or they may be composed of thin membranes of spring steel. Actually, any material can be used which has the required properties of radial strength and axial flexibility.

Figure 4:
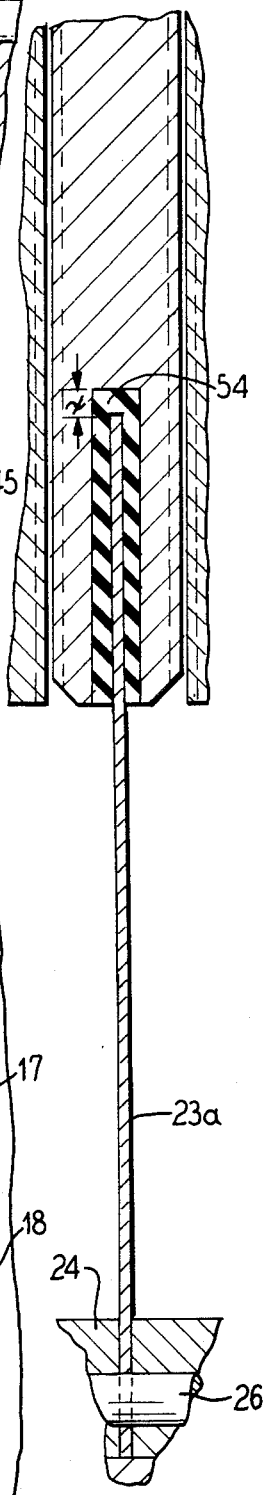
FIG. 4 is an enlarged fragmentary view in cross section of the mounting between a rotor and a refiner rotor disk without deflection of the rotor.
Figure 5:
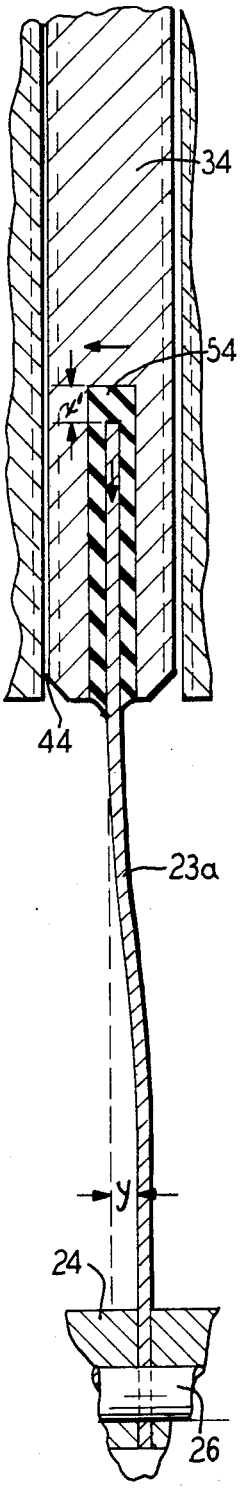
FIG. 5 is a view similar to FIG. 4 but showing a manner in which the rotor is deformed when shearing stresses are applied to the elastomer embedding the rotor.

The present invention is particularly concerned with the manner in which the rotor spokes and the fingers are connected to the respective rotor disks and stator disks to accommodate increased axial movement capability. As seen in FIG. 1, in conjunction with rotor 23, the associated refiner disk 34 may be provided with a slot into which the distal end of the rotor spoke such as rotor spoke 23*a* is loosely received. As illustrated in FIGS. 4 and 5, the ends of the rotor spokes are embedded in a resilient coupling means consisting of a resiliently deformable elastomer 54 which is bonded to the walls of the slot and also to the end of the rotor spoke. The elastomer is arranged to deform in a shearing mode thereby permitting increased axial deflection of the rotor assemblies. The elastomer should have the necessary properties to prevent sagging and to assure concentricity at start-up and running to prevent unbalanced conditions. However, it should be flexible enough to allow the required shear performance without failing, and not imparting excessive stress into the rotors or the refining disks. Suitable elastomers include materials such as the rubbery type silicone (polysiloxane) polymers.

The axial deflection is caused by a combination of the shearing of the elastomer and bending of the fingers. This has been illustrated in FIGS. 4 and 5. In FIG. 4, the character "x" has been applied to the distance between the tip of the spoke 23*a* and the upper surface of the elastomer 54 in the static position of the spoke. In FIG. 5, which shows the deflected position, this distance has been increased to the dimension "x'" due to stretching of the elastomer 54 during deformation. At the same time, the spoke 23*a* is deflected by the distance "y" shown in FIG. 5.

In similar manner, the fingers 48, 49 and 50 are received in suitable slots provided in the respective stator disks as illustrated in FIG. 1. The same type of elastomer can be used to provide an elastomer filler 56 between the finger and the slot in which it is loosely received.

Since the space around each spoke is completely filled with elastomer, no stock can enter the recess for the spoke during operation of the refiner, and there is no packing around the spoke which would interfere with axial adjustment. Also, since the space is completely filled with elastomer, it is not necessary to machine the recess for each spoke to close tolerances, and the refiner will operate correctly even if a relatively large space is provided around the spoke.

The operation of the device of the present invention will be evident from FIGS. 4 and 5. In the unstressed conditions shown in FIG. 4, the rotor spoke 23 is in a relaxed condition. When axial deflection occurs, however, due to unbalancing of the forces in the refiner gaps, the spokes such as spoke 23*a* are pulled downwardly as illustrated by the vertical arrow in FIG. 5. This causes the elastomer 54 to deform in a shearing mode between the spoke 23*a* and the walls of the slot in which the elastomer 54 is bonded. Thus, the effective length of the spoke 23*a* is shortened and the refiner disk 34 tends to move to the left as shown by the horizontal arrow of FIG. 5 thereby narrowing the gap 44.

In the present invention, the axial deflection results from a cantilever bending and the elastomer shear forces at the interface between the rotor and its associated rotor disk. This allows greater axial deflection than is present with normal flexible mounting means, and provides a lower axial spring constant. Additional axial deflection accommodates more plate wear, permitting longer times between plate changes and permitting a higher intensity refining action.

The only tensile force exerted on the rotor is due to the shear force developed upon shearing of the elastomer. The use of a spoked rotor also reduces tensile loading. The rotor and the stator fingers are flexible enough to permit the shearing action without failing, and without imparting excessive stress into the stators, rotors, or refining disks.

The specific embodiment shown in the drawings makes use of sets of rotor and stator disks. It should be understood, however, that the invention is also applicable to sets of disks which rotate in opposite directions to achieve the refining action.

It should be evident that various modifications can be made to the described embodiments without departing from the scope of the present invention.

I claim as my invention:

1. A multiple disk refiner comprising:

a housing, a rotatable hub mounted for rotation within said housing, a plurality of spaced refiner rotor disks concentric with said rotatable hub, a plurality of spaced additional disks in interleaved relation with said rotor disks and defining passages therewith through which a suspension to be refined can be passed, means for creating relative rotational movement between said rotor disks and said additional disks, a plurality of flexible rotor elements mounted on said hub for rotation therewith, and resilient coupling means connecting said flexible rotor elements with said rotor disks, said coupling means including a resiliently deformable elastomer providing a driving connection between said flexible rotor elements and said rotor disks and arranged to deform in a shearing mode thereby permitting increased axial deflection of said flexible rotor elements.

2. A refiner assembly according to claim 1 wherein said flexible rotor elements have radially extending spokes, and said rotor disks have slots into which said spokes extend, said elastomer filling the spaces between said spokes and said slots.

3. A refiner according to claim 2 wherein the ends of said spokes are embedded in said elastomer, said elastomer being bonded to the walls of said slots.

4. A refiner according to claim 2 wherein said spokes are separated by arcuate recesses for directing the flow of suspension therethrough.

5. A refiner according to claim 1 wherein said elastomer is a silicone rubber.

6. A refiner according to claim 1 which includes:

spaced support means secured to said housing, flexible fingers extending from said support means, said additional disks being stationary and having slots therein receiving said fingers in loosely fitting relation, and a resiliently deformable elastomer bonding said fingers to said slots to permit shearing deformation of said elastomer upon axial deflection of said fingers.

* * * * *